United States Patent [19]

Handa

[11] Patent Number: 5,006,084

[45] Date of Patent: Apr. 9, 1991

[54] SHIFT DEVICE FOR MARINE PROPULSION

[75] Inventor: Kenichi Handa, Hamamatsu, Japan

[73] Assignee: Sanshin Kogyo Kabushiki Kaisha, Hamamatsu, Japan

[21] Appl. No.: 257,710

[22] Filed: Oct. 14, 1988

[30] Foreign Application Priority Data

Oct. 16, 1987 [JP] Japan ..... 62-261444

[51] Int. Cl.[5] ..... B63H 23/02

[52] U.S. Cl. ..... 440/75; 74/323; 192/109 A; 192/51; 440/900

[58] Field of Search ..... 440/75, 83, 78, 86; 74/323, 324, 322, 337.5; 192/51, 109 A, 114 R

[56] References Cited

U.S. PATENT DOCUMENTS 1,504,084 8/1924 Spencer ..... 74/324
4,223,773 9/1980 Croisant et al. ..... 192/109 A
4,579,204 4/1986 Iio ..... 192/109 A

FOREIGN PATENT DOCUMENTS 840493 4/1952 Fed. Rep. of Germany ..... 74/323
509883 1/1955 Italy ..... 192/51
6025886 2/1965 Japan .
62-101947 5/1987 Japan .

*Primary Examiner*—Joseph F. Peters, Jr.
*Assistant Examiner*—Edwin L. Swinehart
*Attorney, Agent, or Firm*—Ernest A. Beutler

[57] ABSTRACT

A marine propulsion forward, neutral, reverse transmission incorporating a single spring for yieldably cushioning the shifting into either forward or reverse. Various embodiments of detent mechanisms and spring locations are illustrated as is an arrangement for providing a different spring loading in one direction from the opposite direction.

5 Claims, 5 Drawing Sheets

SHIFT DEVICE FOR MARINE PROPULSION

BACKGROUND OF THE INVENTION

This invention relates to a shift device for a marine propulsion and more particularly to an improved shifting mechanism for a transmission.

In one widely used form of transmission, which is used principally in the forward, neutral, reverse transmission of a marine outboard drive, there are a pair of counter-rotating bevel gears that are journaled relative to the shaft to be driven. A dog clutching element is supported between these gears and has dog clutching teeth that are adapted to engage with corresponding dog clutching teeth of selected ones of the gears for rotatably coupling that gear to the driven shaft.

Although this type of transmission has the advantage of extreme simplicity, the engagement of the dog clutching elements can give rise to noise and also can be otherwise difficult to make shift smoothly. Therefore, it has been proposed to employ some form of spring mechanism in the actuator for the dog clutching element so as to reduce shock. In addition, a detent mechanism may cooperate with the spring so as to permit loading of the spring until the detent releases and then effect snap engagement of the dog clutching elements.

The use of such an arrangement has advantages, however, the use of the single spring arrangement for effecting both snap action and for cushioning the engagement can give rise to certain difficulties and compromises. With such an arrangement it may be important to provide a delicate adjustment of the preloading of the spring and normally two springs may be employed for this purpose, thus complicating the preloading of the springs. This is particularly important in connection with marine transmissions since the construction is very compact but nevertheless employs a large number of components.

It has also been proposed to employ separate spring arrangements for achieving the snap action and the cushioning operation, but the devices of this type have been rather complicated and, in many instances, only provide spring cushioning in one direction of movement. If spring action is provided in both directions, the previously proposed devices have necessitated the use of a multiplicity of springs.

It is, therefore, a principal object of this invention to provide an improved shifting device for a transmission.

It is a further object of this invention to provide an improved shifting device for the dog clutching element of a transmission.

It is a further object of this invention to provide an improved shifting and cushioning arrangement for a transmission of the type normally used in marine propulsion units.

SUMMARY OF THE INVENTION

A first feature of this invention is adapted to be embodied in a shifting arrangement for a transmission that is comprised of a pair of counter-rotating gears that are journaled relative to a shaft. A dog clutching element has dog clutching teeth for cooperation with cooperating teeth on the gears for selectively coupling the dog clutching element for rotation with selected of the gears. The dog cluching element is moveable in a first direction to couple with a first of the gears and in an opposite direction for coupling with the other of the gears. Shifting means are incorporated for moving the dog clutching element in either of the directions. In accordance with this feature of the invention, a single biasing spring yieldably connects the shifting means to the dog clutching element in both directions of its movement for cushioning the engagement of the dog clutching teeth.

DETAILED DESCRIPTION OF THE PREFERRED EMBODIMENTS OF THE INVENTION

Figure 1:
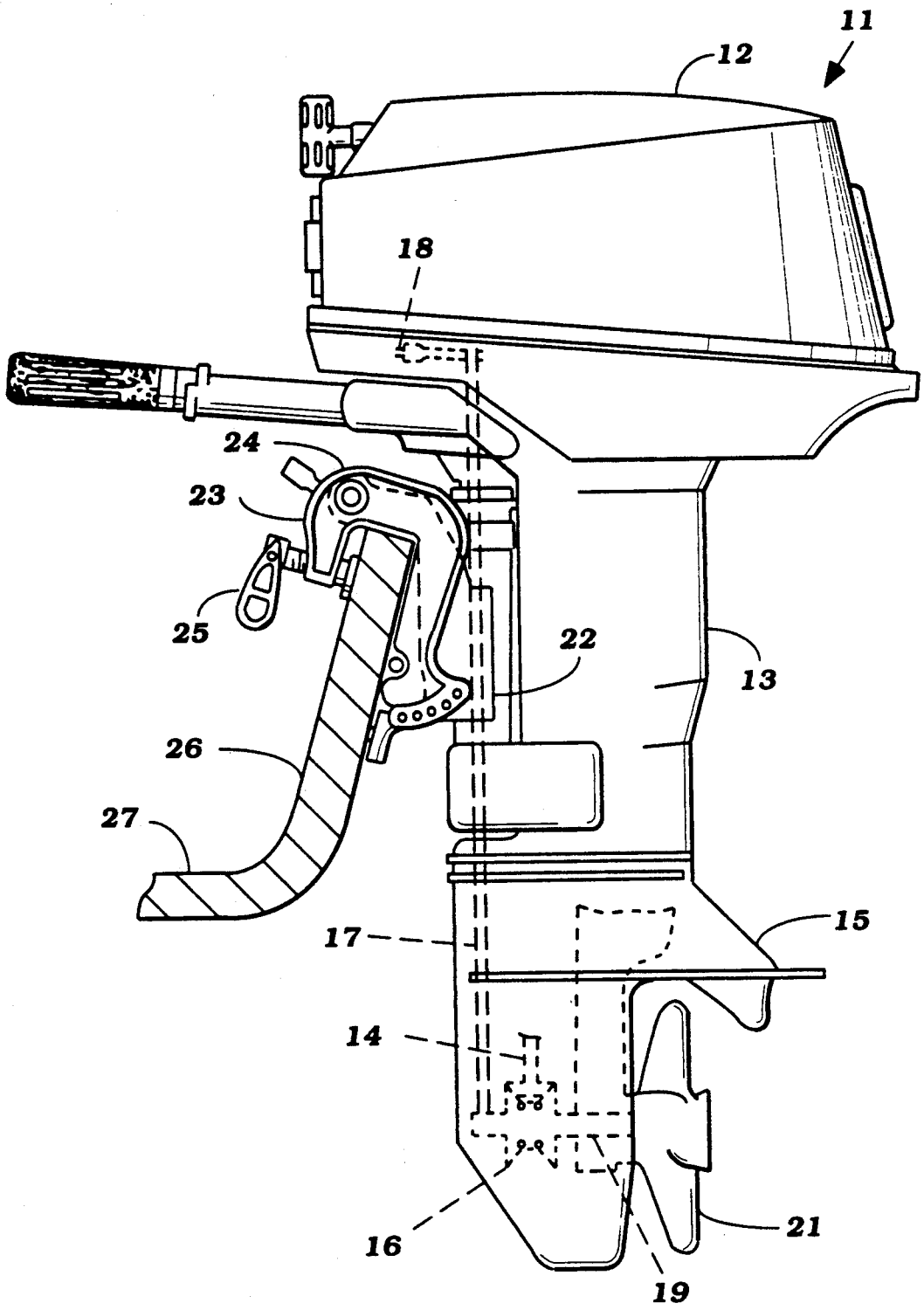
FIG. 1 is a side elevational view of an outboard motor constructed in accordance with a first embodiment of the invention and shows the general environment in which the various embodiments may be employed.

Referring first to FIG. 1, an outboard motor is identified generally by the reference numeral 11 and illustrative of a typical environment in which the invention may be employed. The invention has particular utility in conjunction with marine outboard drives such as the outboard motor 11 or the outboard drive portion of an inboard/outboard drive. It is to be understood, however, that certain facets of the invention may be employed in conjunction with other types of transmissions.

The outboard motor 11 is comprised of a powerhead 12 that includes an internal combustion engine of any known type and which normally drives an output shaft that rotates about a vertically extending axis. A protective cowling encircles the internal combustion engine.

A drive shaft housing 13 depends from the powerhead 12 and rotatably journals a drive shaft 14 that is coupled to the engine output shaft and which also rotates about a generally vertically extending axis. The drive shaft 14 extends through a lower unit 15 and therein drives a forward, neutral, reverse transmission 16 of a type which will be described and which includes a shifting mechanism. This shifting mechanism is operated by a shift rod 17 that extends vertically through the lower unit 15 and drive shaft housing 13 and has a shift lever 18 connected to its upper end so that an operator can selectively shift the transmission 16 between the forward, neutral and reverse modes.

The transmission 16 selectively drives a propeller shaft 19 that is journaled in the lower unit 15 and to which a propeller 21 is affixed for rotation.

A swivel bracket 22 is connected to the drive shaft housing 13 by means of a vertically extending steering shaft (not shown) for steering of the outboard motor 11.

The swivel bracket 22 is, in turn, connected to a clamping bracket 23 by means of a pivot pin 24 for tilt and trim adjustment and for tilting the outboard motor 11 up to an out of the water position. The clamping bracket 23 includes clamping means 25 for detachably connecting the outboard motor 11 to a transom 26 of an associated watercraft 27.

It should be noted that the construction as thus far described may be considered to be conventional and since the invention relates primarily to the transmission 16 and its shifting mechanism, further description of FIG. 1 is believed to be unnecessary.

Figure 2:
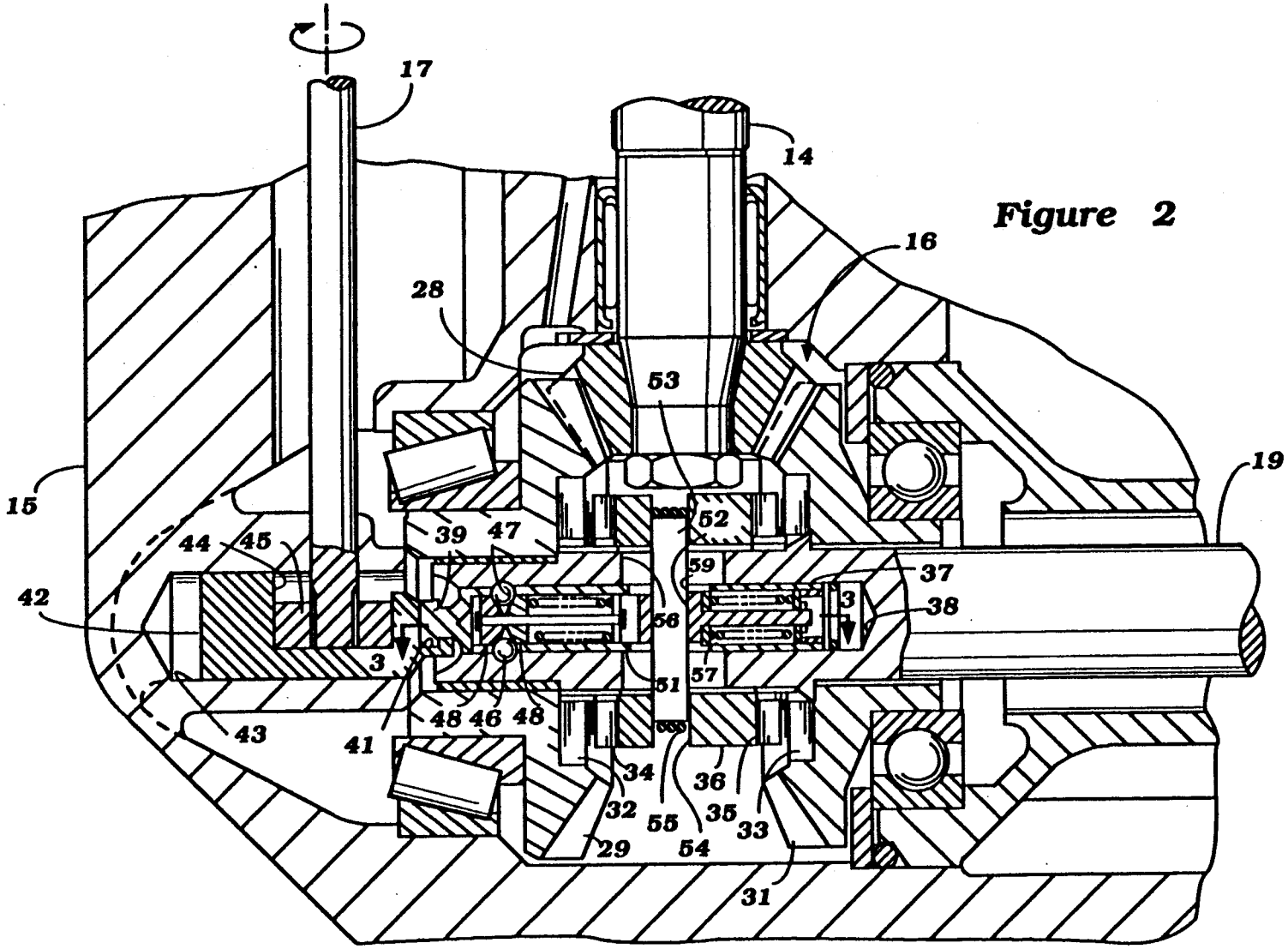
FIG. 2 is an enlarged cross-sectional view showing the transmission mechanism of a first embodiment.
Figure 3:
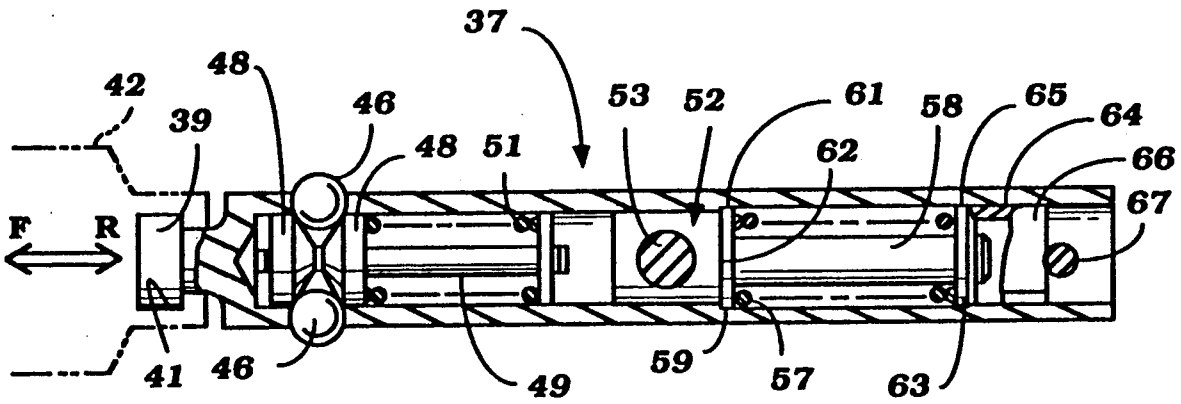
FIG. 3 is a cross-sectional view of the shifting mechanism taken along a plane perpendicular to the plane of FIG. 2.

Referring now in detail to FIGS. 2 and 3, the transmission 16 includes a bevel gear 28 that is affixed in a suitable manner for rotation with the lower end of the drive shaft 14. The bevel gear 28 is enmeshed with a pair of diametrically opposed driven bevel gears 29 and 31 so that the gears 29 and 31 will be driven by the gear 28 in opposite directions of rotation.

The gears 29 and 31 are rotatably journaled in any known manner relative to the propeller shaft 19 and have facing dog clutching teeth 32 and 33. The dog clutching teeth 32 and 33 are adapted to be engaged by corresponding dog clutching teeth 34 and 35 of a dog clutching sleeve 36. The dog clutching sleeve 36 has a splined connection with the propeller shaft 19 and is disposed between the gears 29 and 31 and axially movable along the propeller shaft 19. Axial movement of the dog clutching element 36 will bring selected of the teeth 34, 32 or 33, 35 into engagement for driving the propeller shaft 19 in either forward or reverse directions. The dog clutching sleeve 36 also has a neutral position, as shown in the figures, wherein all of the teeth 32, 34 and 33, 35 are out of engagement. This constitutes the neutral condition for the transmission 16.

The dog clutching sleeve 36 is operated by means of a shifting plunger 37 that is slidably supported within a counterbore 38 formed in the propeller shaft 19. This shifting plunger 37 has a headed end portion 39 that is received within a complementary recess 41 of a shifting cam 42. The shifting cam 42 is slidably supported in a bore 43 formed in the lower unit 15 at one end of the propeller shaft 19. The shifting cam 42 has a cam surface 44 that is engaged by a cam lug 45. The cam lug 45 is in turned splined to the lower end of the shaft rod 17. The shift rod 17 is in turn torsionally resilient for a purpose to be described.

A detent mechanism is incorporated for holding the shifting plunger 37 against movement until a predetermined degree of torsional windup in the shift rod 17 has occurred. This detent mechanism then releases so that the shift plunger 37 will be operated by means of a spring force so as to effect a sudden shifting of the dog clutching element 36 so as to force its teeth 34 or 36 into quick engagement with the teeth 32 or 33 of the gears 29 and 31, depending upon the direction in which the operator wishes to have the watercraft operated.

This detent mechanism comprises a plurality of detent balls 46 that are supported in openings in the shift plunger 37. The detent balls 46 are biased outwardly into engagement with corresponding detent recesses 47 formed in the propeller shaft 19 by means of a pair of conically shaped thrust members 48. One of the thrust members 48 is affixed to a rod 49 while the other of the thrust members is slidably supported upon this rod. A coil compression spring 51 operates on the rod 49 and the slidably supported plunger 48 so as to urge the detent balls 46 outwardly. When sufficient force has been applied through the winding up of the shift rod 17, the force of the spring 51 will be overcome and the balls will be cammed inwardly so as to permit shifting in either the forward or reverse directions.

A shock absorbing assembly is interposed between the shift plunger 37 and the dog clutching sleeve 36 so as to absorb the loads and permit some yielding upon engagement of the gears so as to protect the mechanism and cushion the shifts. This shock absorbing mechanism includes a cylindrical member 52 that is slidably supported within a bore of the shifting plunger 37 and which is connected to a pin 53. The pin 53 extends transversely through a recess 54 formed in the dog clutching sleeve 36 and is held in place by means of a torsional spring 55. As a result, the dog clutching sleeve 36 and cylindrical member 52 are movable axially with each other. An elongated slot 56 is formed in the propeller shaft 19 so as to accommodate sufficient axial movement to permit the shifting into either forward or reverse positions.

A cushioning spring 57 is interposed between the shifting plunger 37 and the cylindrical member 52. The spring 57 encircles a piston rod 58 that is fixed to the cylindrical member 52 and is engaged at one end with a washer 59 that is received within a counterbore 61 of the shifting plunger 37 and which defines a shoulder 62 adjacent the neutral position of the cylindrical member 52. A washer 63 is affixed axially in one direction to the other end of the piston rod 58 by means of a snap ring 64. The coil compression spring 57 is loaded between the washers 59 and 63 and normally holds the piston 52 in its neutral position. The washer 63 is normally engaged with a shoulder 65 formed on a sleeve 66 that is axially affixed to the shifting plunger 37 by means of a transversely extending pin 67. The positioning of the pin 67 axially along the shifting plunger 37 will adjust the preload on the spring 57. Also shims may be employed for preload adjustment as will be described.

If there is resistance to the engagement of the dog clutching teeth 32, 34 or 33, 35 the shifting plunger 37 will move relative to the pin 53 and permit the absorbing of the shock under these conditions. If there is a shock when shifting in the forward direction, the cylindrical member 52 will be held in position while the plunger 37 will move to the left as shown in the figures and load the spring 57 against the shoulder 62 through the washer 59. If there is a shock in the reverse direction, the spring 57 will be loaded against the washer 63 which will engage the shoulder 65 so that the plunger 37 may move to the right as seen in FIG. 3 relative to the cylindrical member 52 and absorb the shock in this direction. As a result, a single spring operates to absorb the shock in either direction of transmission shifting.

Although the preload of the spring 57 can be initially adjusted by the placement of the pin 67, it is easy to change the preload merely by withdrawing the shifting plunger 37 and appropriately placing shim washers in the system. Also some lost motion in movement before the spring action becomes effective is possible by proper placement of shims.

Figure 4:
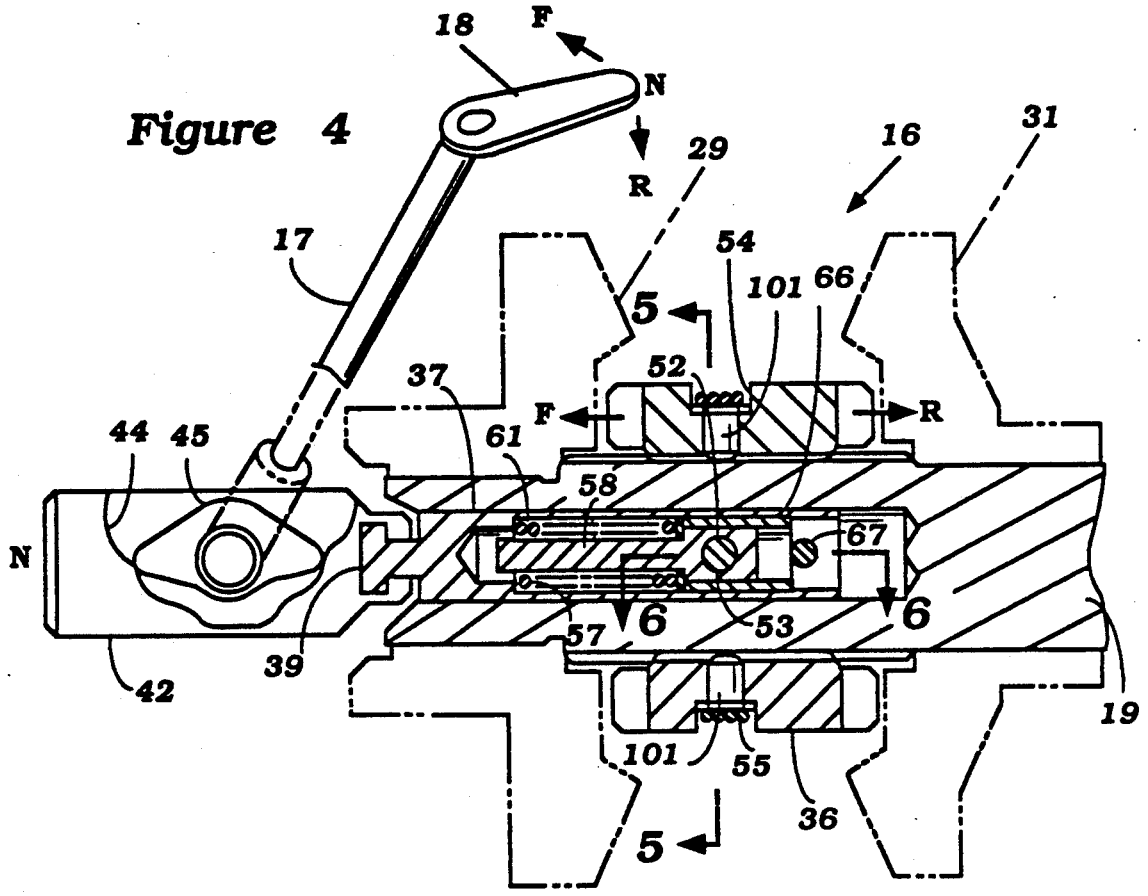
FIG. 4 is a partially schematic cross-sectional view taken through the transmission of a further embodiment of the invention.
Figure 5:
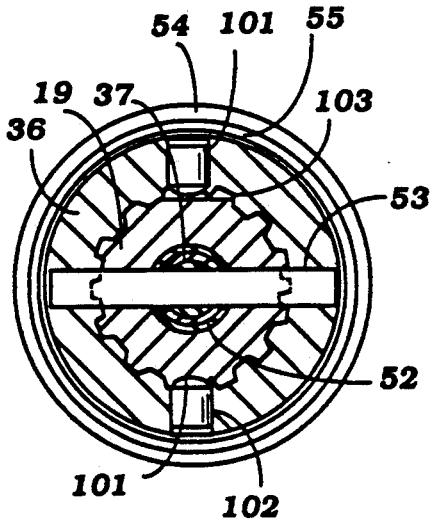
FIG. 5 is a cross-sectional view taken along the line 5—5 of FIG. 4.
Figure 6:
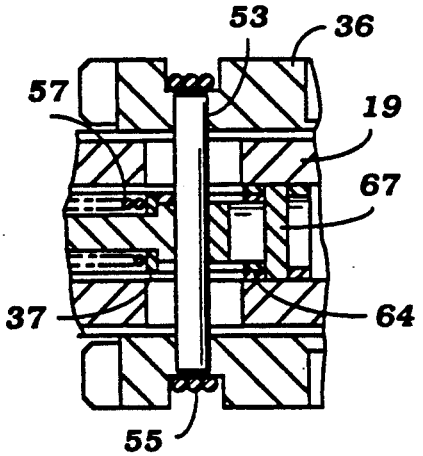
FIG. 6 is a cross-sectional view taken along the line 6—6 of FIG. 4.

FIGS. 4 through 6 show another embodiment of the invention which is generally similar to the embodiment of FIGS. 1 through 3 and, for that reason, components which are the same as the previously described embodiment have been described by the same reference numerals and will only be described again insofar as is necessary to understand the construction and operation of this embodiment. Basically, in this embodiment, the cushioning spring 57 is located in the place of the detent mechanism and its biasing spring arrangement of the embodiment of FIGS. 1 through 3 and a different detent mechanism is employed.

In this embodiment, a pair of detent plungers 101 are slidably supported in bores 102 that are disposed at right angles to the pin 53. The plungers 101 are held in engagement with detent recesses 103 by the torsional spring 55 and thus serve to retain the dog clutching sleeve 37 in it neutral position and permit winding up or torsional deflection of the shift rod 17. This device thus operates the same as the embodiment of FIGS. 1 through 3 and further description of the construction and operation of this embodiment is not believed to be necessary to understand the operation.

Figure 7:
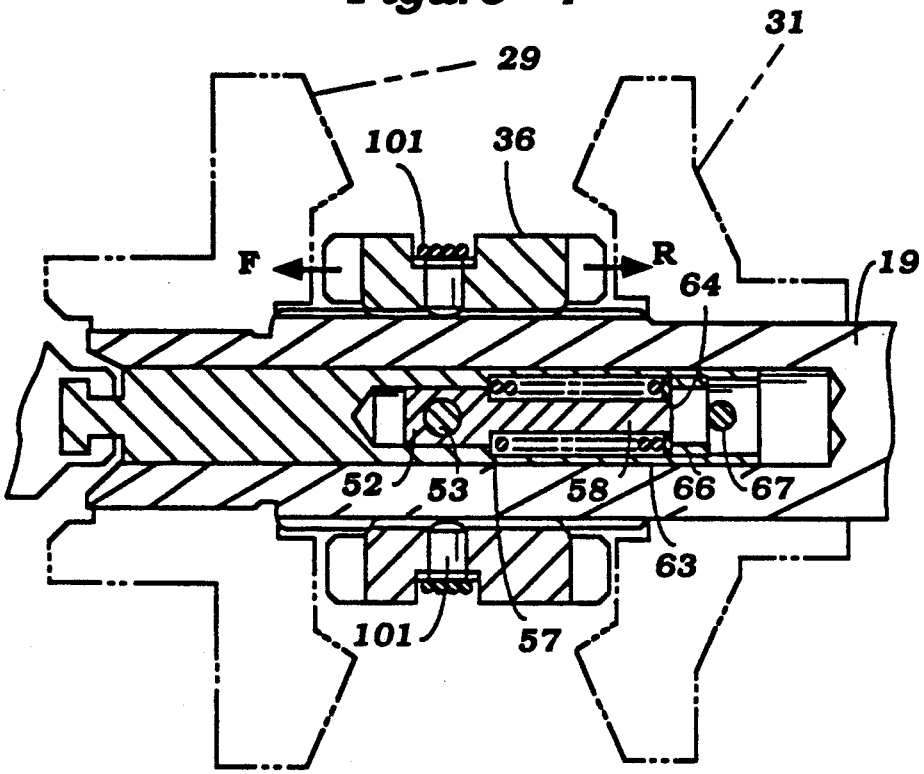
FIG. 7 is a cross-sectional view, in part similar to FIG. 4, showing another embodiment of the invention.

FIG. 7 shows another embodiment of the invention which is generally the same as the embodiment of FIGS. 4 through 6 but in this embodiment the cushioning spring 57 is placed on the same side of the pin 53 as in the embodiment of FIGS. 1 through 3. However, the detent mechanism of FIGS. 4 through 6 is employed. For these reasons, components of this embodiment which are the same as the previously described embodiments have been identified by the same reference numerals and for this reason, further description of the construction and operation of this embodiment is believed to be unnecessary.

Figure 8:
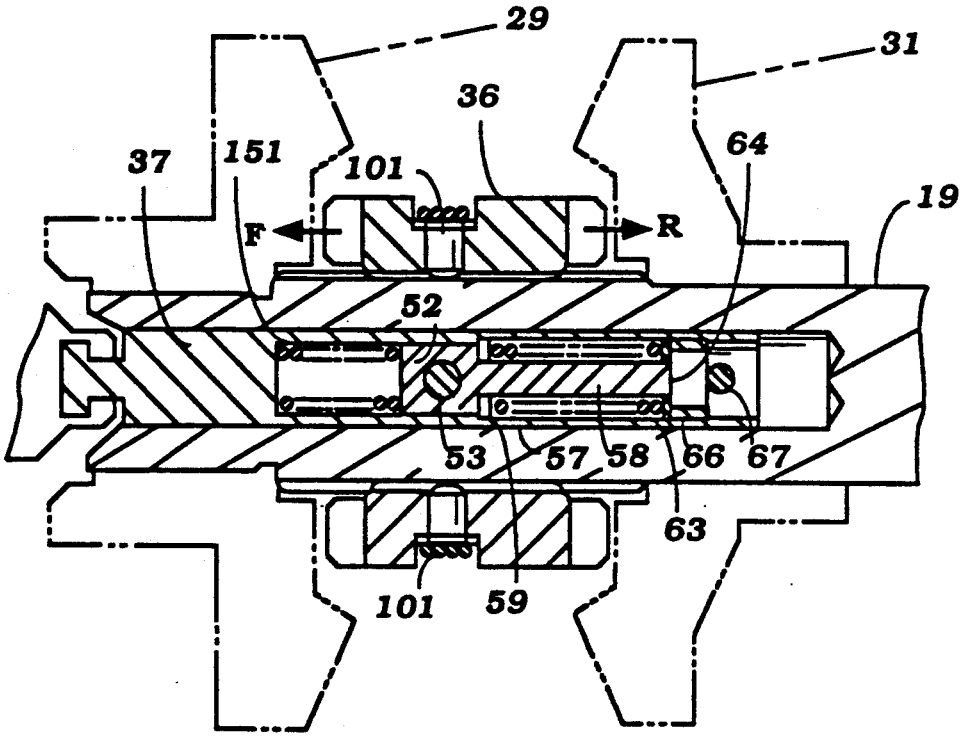
FIG. 8 is a cross-sectional view, in part similar to FIGS. 4 and 7, showing yet another embodiment of the invention.

In the embodiments of the invention as thus far described, a single cushioning spring 57 has been effective to cushion the shifting operation in both the forward and reverse directions. In each of these embodiments the preload of the spring 57 and its action is the same in both forward and reverse. In some instances it may be desirable to provide a system in which a different degree is cushioning is provided in forward than in reverse. FIG. 8 shows such an embodiment. This embodiment is generally the same as the embodiment of FIG. 7 and, for that reason, components which are the same as that embodiment have been identified by the same reference numerals and only the differences between this embodiment and that embodiment are believed to be necessary to understand the construction and operation of this embodiment.

In this embodiment, the bore in which the cylindrical member 52 is slidably supported is lengthened and a coil compression spring 151 is positioned loosely in this bore and engages the cylindrical member 52. The spring 151 will serve to assist the spring 57 in resisting relative movement of the dog clutching sleeve 37 to the left relative to the shifting plunger 37 and thus provides a greater resistance to shock absorption when shifting in reverse than when shifting into forward. An opposite spring placement can achieve the opposite effect.

It should be readily apparent from the foregoing description that a number of embodiments of the invention have been illustrated and described, each of which provides a relatively simple arrangement wherein a single spring can cushion the shifting in both forward and reverse directions. Although a number of embodiments of the invention have been illustrated and described, various changes and modifications may be made without departing from the spirit and scope of the invention, as defined by the appended claims.

I claim:

1. In a shifting arrangement for a transmission comprising a pair of counter-rotating gears journaled relative to a shaft, a dog clutching element having dog clutching teeth for cooperation with cooperating teeth on said gears for selectively coupling said dog clutching element for rotation with selected of said gears, said dog clutching element being moveable in a first direction to couple with a first of said gears and in an opposite direction for coupling with the other of said gears, and shifting means for moving said dog clutching element in either of said directions, the improvement comprising a single biasing coil spring for yieldably connecting said shifting means to said dog clutching element in both directions of movement for cushioning engagement of the dog clutching teeth, said coil spring having one of its ends fixed and the other of its ends moveable when shifting into engagement with one of the gears and the other of its ends moveable and the one of its ends fixed when shifting into engagement with the other of the gears.

2. In a shifting arrangement for a transmission as set forth in claim 1 further including further spring means operating with the single biasing spring for providing a greater degree of cushioning in one direction than the other.

3. In a shifting arrangement for a transmission as set forth in claim 1 further including detent means for yieldably restraining the movement of said dog clutching element and spring means interposed between an operator and said shifting means adapted to become preloaded upon movement of said operator until said detent means is released for snap engagement of the dog clutching elements.

4. In a shifting arrangement for a transmission as set forth in claim 3 further including further spring means operating with the single biasing spring for providing a greater degree of cushioning in one direction than the other.

5. In a shifting arrangement for a transmission as set forth in claim 4 wherein the spring means comprises a torsional shift rod operatively connecting the operator with the shifting means.

* * * * *